US009984611B2

(12) United States Patent
Li et al.

(10) Patent No.: US 9,984,611 B2
(45) Date of Patent: May 29, 2018

(54) DISPLAY APPARATUS AND OPERATING METHOD THEREOF

(71) Applicant: Raydium Semiconductor Corporation, Hsinchu (TW)

(72) Inventors: Hung Li, Taipei (TW); Feng-Li Lin, Hsinchu (TW); Shua Shen Hsiao, Chiayi (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 113 days.

(21) Appl. No.: 15/236,646

(22) Filed: Aug. 15, 2016

(65) Prior Publication Data

US 2017/0103692 A1 Apr. 13, 2017

(30) Foreign Application Priority Data

Oct. 8, 2015 (TW) ..... 104133255 A

(51) Int. Cl.

*G09G 5/10* (2006.01)
*G09G 3/20* (2006.01)
*G09G 3/36* (2006.01)

(52) U.S. Cl.

CPC ..... *G09G 3/2003* (2013.01); *G09G 3/3611* (2013.01); *G09G 2320/0686* (2013.01); *G09G 2330/022* (2013.01)

(58) Field of Classification Search

CPC ..... G09G 3/2003; G09G 3/3611; G09G 2320/0686; G09G 2330/022

See application file for complete search history.

(56) References Cited

U.S. PATENT DOCUMENTS

2012/0320009 A1* 12/2012 Liu ..... G09G 3/3648 345/204
2014/0125708 A1* 5/2014 Chen ..... G09G 3/2007 345/690
2015/0138261 A1* 5/2015 Nakayama ..... G06F 1/3265 345/694

* cited by examiner

*Primary Examiner* — Rodney Amadiz

(57) ABSTRACT

A display apparatus and operating method thereof are disclosed. The display apparatus includes a display panel and a driving IC. A display area of the display panel is divided into sub-display areas. The driving IC is coupled to the display panel. The driving IC includes registers corresponding to the sub-display areas respectively. The driving IC receives a display data and obtains a plurality of color information corresponding to the sub-display areas respectively according to the display data, and then stores the plurality of color information in the registers respectively. When the frame display by the display panel has not to be refreshed, the driving IC stops receiving the display data and converts the plurality of color information stored in the registers into corresponding colors respectively and outputs them to the sub-display areas of the display panel to display.

12 Claims, 4 Drawing Sheets

DISPLAY APPARATUS AND OPERATING METHOD THEREOF

BACKGROUND OF THE INVENTION

1. Field of the Invention

This invention relates to a display apparatus, especially to a display apparatus and operating method thereof capable of reducing the size of data storage space and increasing the color changes in the displayed frame.

2. Description of the Prior Art

In general, the conventional display driving IC includes a frame RAM (or a frame buffer). When the frame displayed by the panel needs not to be refreshed, the display driving IC will stop receiving new display data from the data source, and the only thing that the display driving IC needs to do is to access and output the display data previously stored in the frame RAM (or the frame buffer). Therefore, it can achieve the effects of saving the data transmission power.

However, with the increasing of the resolution of the display, the capacity of the frame RAM (or the frame buffer) needed and the area of the display driving IC will also become larger. In addition, the manufacturing process of the display driving IC will also become more advanced and complicated due to the needs of higher memory density. These factors will cause the largely increasing of the costs of the display driving IC.

In order to improve the above-mentioned drawbacks, "the RAM-Less driving IC" is generated accordingly. As the name suggests, the RAM-Less driving IC does not include the frame RAM (or the frame buffer). However, this also means that the RAM-Less driving IC has to continuously obtain new display data from the data source. It will also largely increase the data transmission power.

Therefore, if the quality of the display screen is not so important, the display driving IC can use the "1 bit RAM" technology to store the 24 bits input display data in the 1 bit memory capacity, so that the size of the memory can be largely reduced. When the frame displayed by the panel needs not to be refreshed, the only thing that the display driving IC needs to do is to access the display data previously stored in the frame RAM (or the frame buffer) and perform color transformation on it and then output it to the panel; therefore, the data transmission power can be also reduced. However, the biggest drawback is that high compression led to a substantial decline in the quality of the display image, when the panel display the frame, only two colors can be displayed in the entire display area at the same time, as shown in FIG. 1, so that the colors displayed on the panel will be too monotonous and the panel will fail to provide the display image having good quality.

SUMMARY OF THE INVENTION

Therefore, the invention provides a display apparatus and operating method thereof capable of reducing the size of data storage space and increasing the color changes in the displayed frame to solve the above-mentioned problems in the prior arts.

An embodiment of the invention is a display apparatus. In this embodiment, the display apparatus includes a display panel and a driving IC. The display panel has a display area, wherein the display area of the display panel is divided into a plurality of sub-display areas. The driving IC is coupled to the display panel. The driving IC includes a plurality of registers corresponding to the plurality of sub-display areas respectively, wherein the driving IC is configured to receive a display data and obtain a plurality of color information corresponding to the plurality of sub-display areas respectively according to the display data, and then the driving IC is configured to store the plurality of color information in the plurality of registers respectively. When the frame displayed on the display panel needs not to be refreshed, the driving IC is configured to stop receiving the display data and convert the plurality of color information stored in the plurality of registers into a plurality of corresponding colors respectively and then output the plurality of corresponding colors to the plurality of sub-display areas of the display panel to display.

In an embodiment, a number, a shape, an area size and an arrangement of the plurality of sub-display areas can be elastically adjusted.

In an embodiment, the plurality of registers is all 1-bit memory.

In an embodiment, the plurality of color information all includes a first value or a second value representing different colors respectively.

In an embodiment, the plurality of sub-display areas is (M*N) sub-display areas and the plurality of registers is (M*N) registers corresponding to the (M*N) sub-display areas respectively, M and N are both positive integers.

In an embodiment, the display area of the display panel is divided into N columns of sub-display areas along a horizontal direction and each column of sub-display areas includes M sub-display areas; the display area of the display panel is also divided into M rows of sub-display areas along a vertical direction and each row of sub-display areas includes N sub-display areas.

Another embodiment of the invention is a display apparatus operating method used to operate a display apparatus including a display panel and a driving IC. The display apparatus operating method includes steps of: dividing a display area of the display panel into a plurality of sub-display areas; disposing a plurality of registers corresponding to the plurality of sub-display areas respectively on the driving IC; the driving IC receiving a display data and obtaining a plurality of color information corresponding to the plurality of sub-display areas respectively according to the display data, and then the driving IC storing the plurality of color information in the plurality of registers respectively; and when the frame displayed on the display panel needs not to be refreshed, the driving IC stopping receiving the display data and converting the plurality of color information stored in the plurality of registers into a plurality of corresponding colors respectively and then outputting the plurality of corresponding colors to the plurality of sub-display areas of the display panel to display.

Compared to the prior arts, although the display recording information and the display recording information generation method of the invention also use the "1 bit RAM" to largely reduce the necessary size of memory and reduce the data transmission power, the display recording information and the display recording information generation method of the invention further use specific compression method to compress the display data at first and then store the compressed display data in the 1 bit RAM. When the frame displayed by the panel needs not to be refreshed, the display driving IC only needs to access the compressed display data previously stored in the 1 bit RAM and perform color transformation on it and then output it to the panel without reducing the quality of the display image. Therefore, the display recording information and the display recording information generation method of the invention can achieve the effects of reducing the data storage space, saving the data transmission power, reducing the costs of the driving IC of the display and enhancing the quality of the display image at the same time.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

Figure 1:
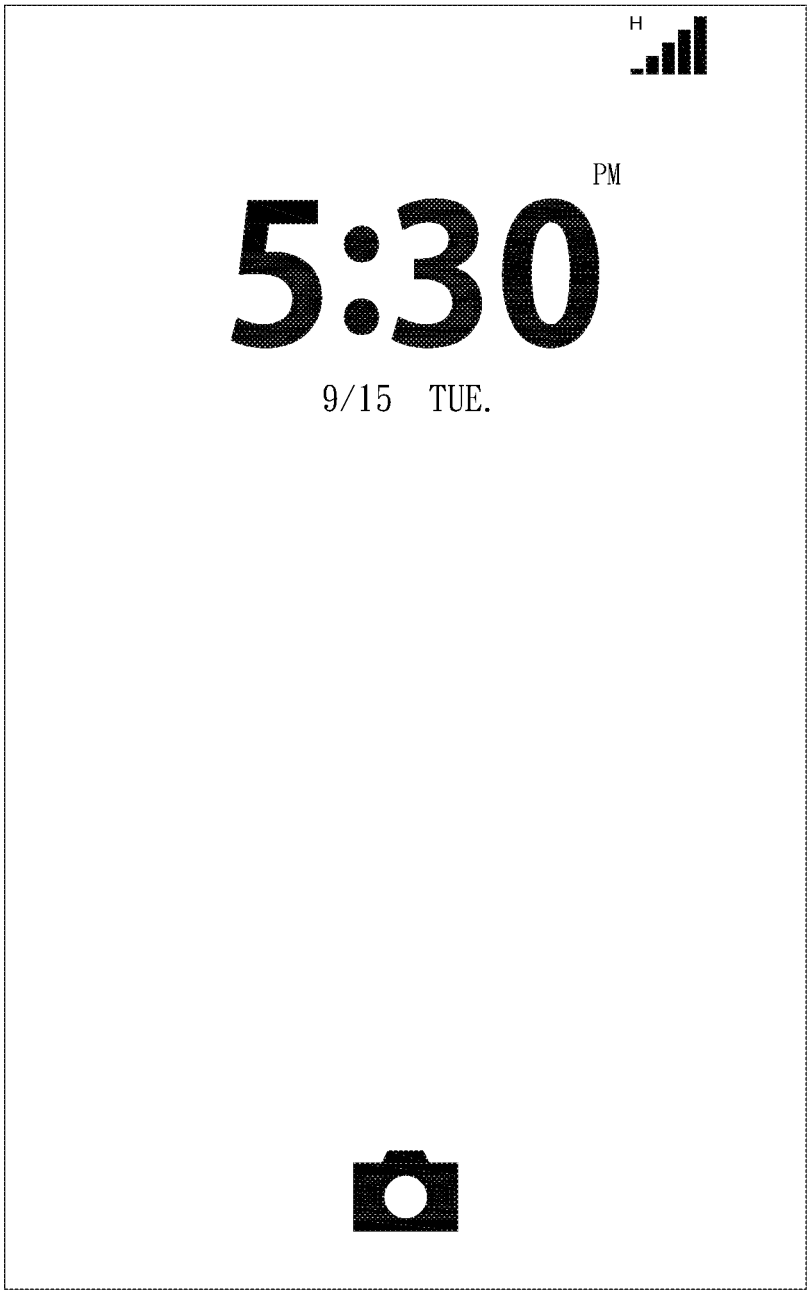
FIG. 1 (PRIOR ART)
FIG. 1 illustrates a schematic diagram of the conventional display apparatus using the "1 bit RAM" technology can only display two colors at the same time.
Figure 2:
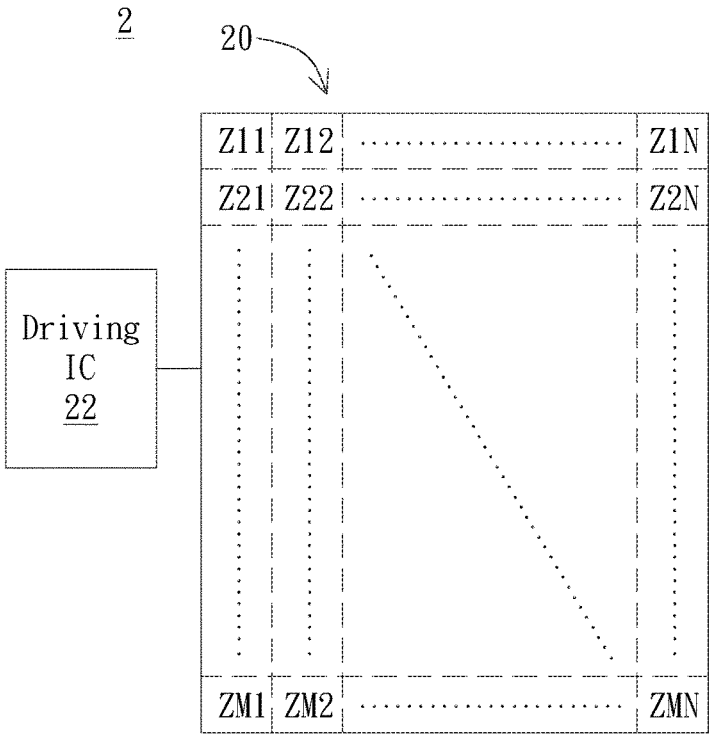
FIG. 2 illustrates a schematic diagram of the display apparatus including a plurality of sub-display areas in an embodiment of the invention.

A preferred embodiment of the invention is a display apparatus. In this embodiment, the display apparatus is a liquid crystal display which can be applied to any electronic apparatus as monitor. As shown in FIG. 2, the display apparatus 2 includes a display panel 20 and a driving IC 22, and the driving IC 22 is coupled to the display panel 20, but not limited to this.

In practical applications, the entire display area of the display panel 20 can be divided into a plurality of sub-display areas and a number, a shape, an area size and an arrangement of the plurality of sub-display areas can be elastically adjusted without any specific limitations.

As shown in FIG. 2, the entire display area of the display panel 20 can be divided into (M*N) sub-display areas Z11~ZMN, wherein M and N are positive integers.

In detail, in view of the horizontal direction, the entire display area of the display panel 20 can be divided into N rows of sub-display areas along the horizontal direction and each row of sub-display areas includes M sub-display areas; in view of the vertical direction, the entire display area of the display panel 20 can be divided into M columns of sub-display areas along the vertical direction and each column of sub-display areas includes N sub-display areas.

For example, if M=8 and N=6, it means that the entire display area of the display panel 20 is divided into (8*6)=48 sub-display areas Z11~Z86. In view of the horizontal direction, the entire display area of the display panel 20 is divided into 6 rows of sub-display areas along the horizontal direction and each row of sub-display areas includes 8 sub-display areas; in view of the vertical direction, the entire display area of the display panel 20 is divided into 8 columns of sub-display areas along the vertical direction and each column of sub-display areas includes 6 sub-display areas.

Figure 3:
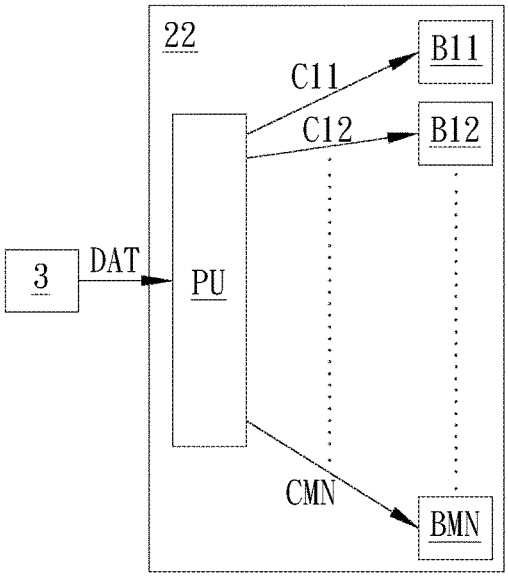
FIG. 3 illustrates a schematic diagram of the driving IC shown in FIG. 2 including a plurality of registers.

Then, please refer to FIG. 3. FIG. 3 illustrates a schematic diagram of the driving IC shown in FIG. 2 including a plurality of registers. As shown in FIG. 3, the driving IC 22 includes a processing unit PU and a plurality of registers B11~BMN and the processing unit PU is coupled to the plurality of registers B11~BMN respectively. The plurality of registers B11~BMN corresponds to a plurality of sub-display areas Z11~ZMN of the display panel 20 respectively. It should be noticed that the plurality of registers B11~BMN are all 1 bit memories.

In this embodiment, when the driving IC 22 receives a display data DAT from a display data source 3, the processing unit PU of the driving IC 22 will obtain a plurality of color information C11~CMN corresponding to the plurality of sub-display areas Z11~ZMN respectively according to the display data DAT, and then the driving IC 22 will store the plurality of color information C11~CMN in the plurality of registers B11~BMN respectively.

It should be noticed that the plurality of color information C11~CMN can include a first value or a second value representing different colors. For example, if the first value of the plurality of color information C11~CMN is 1 and the second value of the plurality of color information C11~CMN is 0, it can be set that the when the color information C11 corresponding to the sub-display area Z11 is 1, the color displayed by the sub-display area Z11 will be white and when the color information C11 is 0, the color displayed by the sub-display area Z11 will be red, or when the color information C46 corresponding to the sub-display area Z46 is 1, the color displayed by the sub-display area Z11 will be black and when the color information C46 is 0, the color displayed by the sub-display area Z46 will be green, but not limited to this.

When the frame displayed on the display panel 20 needs not to be refreshed, the driving IC 22 will stop receiving any new display data from the display data source 3 and the driving IC 22 will convert the plurality of color information C11~CMN stored in the plurality of registers B11~BMN into a plurality of corresponding colors respectively and then output the plurality of corresponding colors to the plurality of sub-display areas Z11~ZMN of the display panel 20 respectively and the plurality of sub-display areas Z11~ZMN will display corresponding colors respectively.

As stated in the above example, if the color information C11 corresponding to the sub-display area Z11 is 1 and the color information C46 corresponding to the sub-display area Z46 is 0, when the frame on the display panel 20 needs not to be refreshed, the driving IC 22 will directly convert the color information C11 and C46 stored in the registers B11 and B46 into the corresponding white color and green color respectively, and then output them to the corresponding sub-display area Z11 and Z46 of the display panel 20 respectively and the sub-display area Z11 and Z46 will display white color and green color respectively.

By doing so, since each sub-display area Z11~ZMN of the display panel 20 can be set any two different colors respectively, each sub-display area Z11~ZMN will display different colors instead of only displaying two colors at the same time, so that the color of the frame displayed by the entire display area of the display panel 20 will be more colorful.

Figure 4:
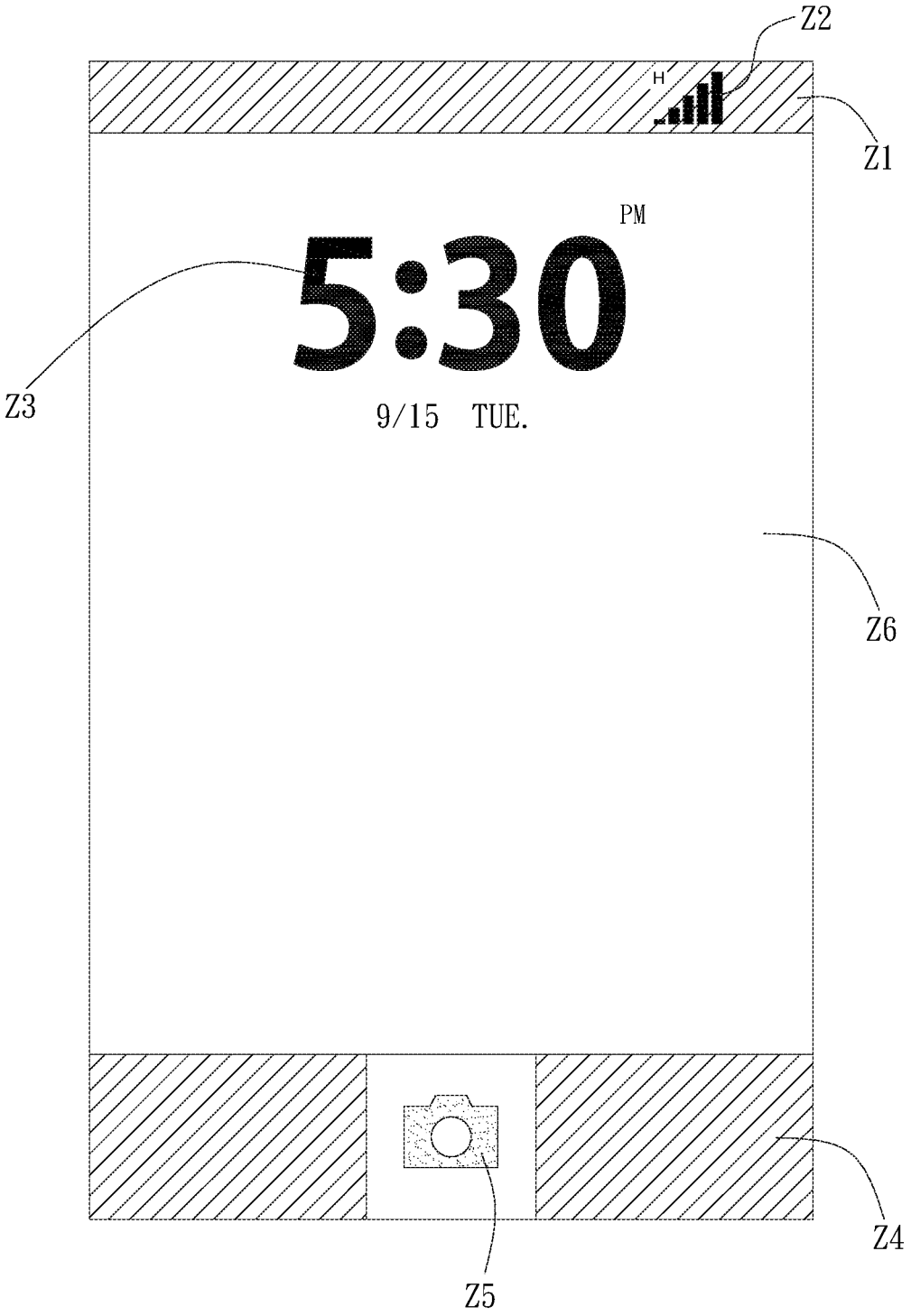
FIG. 4 illustrates a schematic diagram of the display apparatus capable of displaying various kinds of colors at the same time in the invention.

It should be noticed that a number, a shape, an area size and an arrangement of the plurality of sub-display areas divided from the entire area of the display panel 20 can be elastically adjusted based on practical needs. Therefore, as shown in FIG. 4, the entire display area of the display panel 20 can be divided into sub-display areas Z1~Z6 having different shapes, different sizes of area or different arrangements to display corresponding colors respectively. It is not limited by the ordinary matrix arrangement shown in FIG. 3A.

For example, when the display apparatus 2 is operated in a specific display mode or displays a specific theme, the sub-display areas Z1 and Z4 of the display panel 20 can display red color at the same time; the sub-display areas Z2 and Z3 of the display panel 20 can display black color at the same time; the sub-display area Z5 of the display panel 20 can display yellow color; the sub-display area Z6 of the display panel 20 can display white color, but not limited to this.

Another embodiment of the invention is a display apparatus operating method. In this embodiment, the display apparatus operating method is used to operate a display apparatus which is a LCD including a display panel and a driving IC.

Figure 5:
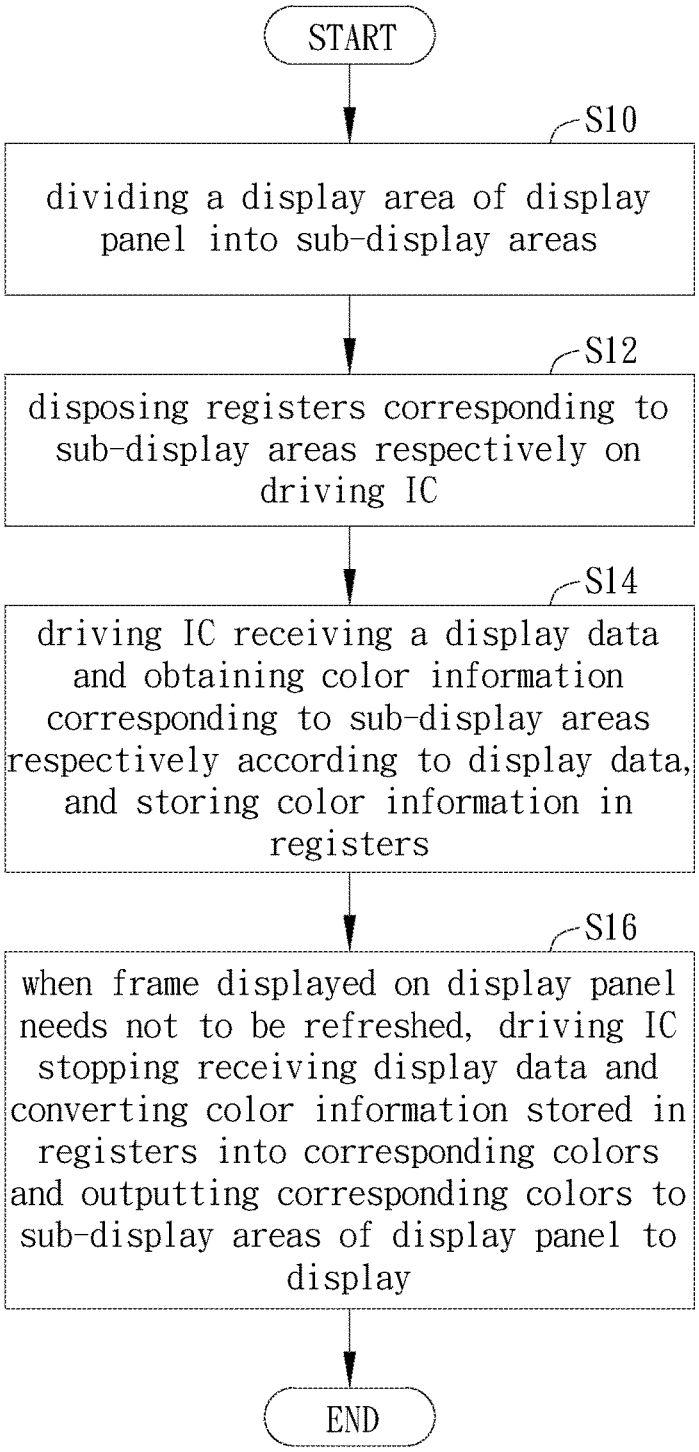
FIG. 5 illustrates a flowchart of the display apparatus operating method in another embodiment of the invention.

Please refer to FIG. 5. FIG. 5 illustrates a flowchart of the display apparatus operating method in this embodiment. As shown in FIG. 5, the display apparatus operating method includes steps of:

Step S10: dividing a display area of the display panel into a plurality of sub-display areas;

Step S12: disposing a plurality of registers corresponding to the plurality of sub-display areas respectively on the driving IC;

Step S14: the driving IC receiving a display data and obtaining a plurality of color information corresponding to the plurality of sub-display areas respectively according to the display data, and then the driving IC storing the plurality of color information in the plurality of registers respectively;

Step S16: when the frame displayed on the display panel needs not to be refreshed, the driving IC stopping receiving the display data and converting the plurality of color information stored in the plurality of registers into a plurality of corresponding colors respectively and then outputting the plurality of corresponding colors to the plurality of sub-display areas of the display panel to display.

In practical applications, a number, a shape, an area size and an arrangement of the plurality of sub-display areas can be elastically adjusted; the plurality of registers is all 1-bit memory; the plurality of color information all includes a first value or a second value representing different colors respectively.

Compared to the prior arts, although the display recording information and the display recording information generation method of the invention also use the "1 bit RAM" to largely reduce the necessary size of memory and reduce the data transmission power, the display recording information and the display recording information generation method of the invention further use specific compression method to compress the display data at first and then store the compressed display data in the 1 bit RAM. When the frame displayed by the panel needs not to be refreshed, the display driving IC only needs to access the compressed display data previously stored in the 1 bit RAM and perform color transformation on it and then output it to the panel without reducing the quality of the display image. Therefore, the display recording information and the display recording information generation method of the invention can achieve the effects of reducing the data storage space, saving the data transmission power, reducing the costs of the driving IC of the display and enhancing the quality of the display image at the same time.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display apparatus, comprising:

a display panel having a display area, wherein the display area of the display panel is divided into a plurality of sub-display areas; and a driving IC coupled to the display panel, the driving IC comprising a plurality of registers corresponding to the plurality of sub-display areas respectively, wherein the driving IC is configured to receive a display data and obtain a plurality of color information corresponding to the plurality of sub-display areas respectively according to the display data, and then the driving IC is configured to store the plurality of color information in the plurality of registers respectively;

wherein when the frame displayed on the display panel needs not to be refreshed, the driving IC is configured to stop receiving the display data and convert the plurality of color information stored in the plurality of registers into a plurality of corresponding colors respectively and then output the plurality of corresponding colors to the plurality of sub-display areas of the display panel to display.

2. The display apparatus of claim 1, wherein a number, a shape, an area size and an arrangement of the plurality of sub-display areas can be elastically adjusted.

3. The display apparatus of claim 1, wherein the plurality of registers is all 1-bit memory.

4. The display apparatus of claim 1, wherein the plurality of color information all comprises a first value or a second value representing different colors respectively.

5. The display apparatus of claim 1, wherein the plurality of sub-display areas is (M*N) sub-display areas and the plurality of registers is (M*N) registers corresponding to the (M*N) sub-display areas respectively, M and N are both positive integers.

6. The display apparatus of claim 5, wherein the display area of the display panel is divided into N columns of sub-display areas along a horizontal direction and each column of sub-display areas comprises M sub-display areas; the display area of the display panel is also divided into M rows of sub-display areas along a vertical direction and each row of sub-display areas comprises N sub-display areas.

7. A display apparatus operating method used to operate a display apparatus comprising a display panel and a driving IC, the display apparatus operating method comprising steps of:

dividing a display area of the display panel into a plurality of sub-display areas;

disposing a plurality of registers corresponding to the plurality of sub-display areas respectively on the driving IC;

the driving IC receiving a display data and obtaining a plurality of color information corresponding to the plurality of sub-display areas respectively according to the display data, and then the driving IC storing the plurality of color information in the plurality of registers respectively; and when the frame displayed on the display panel needs not to be refreshed, the driving IC stopping receiving the display data and converting the plurality of color information stored in the plurality of registers into a plurality of corresponding colors respectively and then outputting the plurality of corresponding colors to the plurality of sub-display areas of the display panel to display.

8. The display apparatus operating method of claim 7, wherein a number, a shape, an area size and an arrangement of the plurality of sub-display areas can be elastically adjusted.

9. The display apparatus operating method of claim 7, wherein the plurality of registers is all 1-bit memory.

10. The display apparatus operating method of claim 7, wherein the plurality of color information all comprises a first value or a second value representing different colors respectively.

11. The display apparatus operating method of claim 7, wherein the plurality of sub-display areas is (M*N) sub-display areas and the plurality of registers is (M*N) registers corresponding to the (M*N) sub-display areas respectively, M and N are both positive integers.

12. The display apparatus operating method of claim 11, wherein the display area of the display panel is divided into N columns of sub-display areas along a horizontal direction and each column of sub-display areas comprises M sub-display areas; the display area of the display panel is also divided into M rows of sub-display areas along a vertical direction and each row of sub-display areas comprises N sub-display areas.

* * * * *